United States Patent [19]

Corbett

[11] 4,453,556

[45] Jun. 12, 1984

[54] SPRAY TREATMENT APPARATUS

[75] Inventor: Sydney C. Corbett, Birmingham, England

[73] Assignee: Hoklykem Holdings Limited, Birmingham, England

[21] Appl. No.: 337,124

[22] Filed: Jan. 5, 1982

[30] Foreign Application Priority Data

Jan. 20, 1981 [GB] United Kingdom ..... 8101673

[51] Int. Cl.[3] ..... B08B 3/02

[52] U.S. Cl. ..... 134/65; 134/69; 134/111

[58] Field of Search ..... 134/65, 69, 111, 152

[56] References Cited

U.S. PATENT DOCUMENTS 1,383,418 7/1921 Needham ..... 134/65 X
3,001,338 9/1961 Parker ..... 134/153
4,073,301 2/1978 Mackinnon ..... 134/65
4,213,475 2/1980 Minkin ..... 134/111

*Primary Examiner*—Robert L. Bleutge
*Attorney, Agent, or Firm*—Shlesinger, Arkwright, Garvey & Fado

[57] ABSTRACT

A spray treatment apparatus for small workpieces, for example for washing and rinsing, comprises several containers arranged for rotation about a common axis and each having an internal generally helical screw feed. Each barrel tapers from its intake end to its output end, which is disposed within the intake end of the next container, to feed workpieces directly. The axis is horizontal and the containers can be rotated independently. Spray heads carrying treatment liquid are spaced from the intake end of each container so that treatment liquid flows back in countercurrent to the workpieces to the intake end where it is collected at, filtered at and recycled to the spray heads.

8 Claims, 3 Drawing Figures

SPRAY TREATMENT APPARATUS

BACKGROUND OF THE INVENTION

This invention relates to a spray treatment apparatus for small workpieces.

Such apparatus may take a variety of forms depending on the particular use to which it is to be put. For example, the apparatus may be provided in the form of a simple washing and rinsing apparatus having two or three stages or may be provided in a greatly extended form for the carrying out of surface treatment processes such as pickling of metal components.

To simplify the following description, the example of a spray washing and rinsing apparatus will be taken but it will be appreciated that, by suitably modifying the details of the apparatus, an apparatus of this type can be put to a large number of other uses.

It has been proposed, for example in British Patent Specification No. 1,035,852, to carry out a washing and rinsing process on small workpieces using a cylindrical drum having a horizontal axis, about which the drum is rotated in use. The drum is made of perforated material so that the treatment liquid can drain away and has an internal helical scroll or Archimedean screw feed means to feed the workpieces along the drum as it rotates. This arrangement has the disadvantage that the treatment liquid is only in contact with the workpieces for a very short time before it drains away through the perforations. Furthermore, any swarf or other small particles of material mixed in with the workpieces may tend to block the drainage holes in the drum so the treatment liquid builds up and has difficulty in draining away, which can result in one liquid being contaminated with that supplied at the next adjacent state for example.

One solution to this problem which has been proposed is on the lines described in British Patent Specification No. 1,558,566, in which imperforate drums are used and the Archimedean scroll is broken by small gaps so that liquid and swarf, but not workpieces, can pass through the scroll. The apparatus includes two or more barrels arranged coaxially about a rotational axis which is inclined to the horizontal. Treatment liquid is sprayed on the workpieces towards the upper end of each barrel and is then allowed to run back through the breaks in the Archimedean scroll to drainage means at the lower end of the barrel.

Unfortunately, this arrangement also has disadvantages when applied to any type of spray treatment machine of more than a couple of stages because each barrel has to be larger than the preceding barrel so that workpieces can feed directly from the upper end of a barrel into the lower end of the next succeeding barrel. Furthermore, the provision of an inclined axis means that, if the machine is extended in length, one end of the machine is likely to be very much higher than the other end, causing problems with factory space, loading and unloading.

It is with these problems in view that the present invention has been devised and it is an object of the invention to provide a spray treatment apparatus for small workpieces which overcomes or reduces these disadvantages.

SUMMARY OF THE INVENTION

According to the invention, there is provided a spray treatment apparatus for small workpieces, the apparatus comprising a frame; a container rotatably mounted on the frame about a generally horizontal rotational axis, the container having an intake end and an output end and a generally helical feed means extending along the interior of the container from the intake to the output end so as to feed workpieces along the container on rotation thereof about its axis; and spray means provided within the container to spray treatment liquid onto workpieces therein; the container tapering inwardly towards the axis considered from the intake to the output end of the container and the spray means being spaced from the intake end.

The expression "generally horizontal" does not exclude an axis slightly inclined to the horizontal so as to tilt upwardly or downwardly (considered in the direction of travel of the workpiece). However, the lowermost surface, for the time being, of the container must always be inclined at least slightly upwardly, so as to permit treatment liquid to drain to the intake end. Furthermore, the slope of this lowermost surface must not be so great as to hinder movement of the workpiece through the container.

Preferably, the apparatus comprises two or more such containers mounted for rotation about a common generally horizontal axis, the output end of one container being disposed within the intake end of the next adjacent container so that workpieces are fed from said one to said next adjacent container on rotation.

The generally helical feed means of the or each container may have a plurality of openings of a size less than the size of the smallest workpiece to be treated, for drainage of treatment liquid towards the intake end of the container.

Liquid drainage means may be provided below the intake end of the or each container. The drainage means may have associated filtering means. Liquid recycling means may be interposed between the drainage means and the spray means for recycling treatment liquid.

Where a plurality of containers are provided, each may be separately mounted for rotation and may be separately driven, whereby the containers may be arranged to rotate at different speeds and/or in opposed rotational directions.

A pair of external parallel, axially spaced apart, coaxial annular tracks may be provided on the or each container, each track being cooperable with a pair of support rollers, so as to provide rotational mounting means for the container.

The or each container may have a plurality of wall panels so as to be polygonal in any cross-section taken perpendicular to its axis. For example the container may have eight walls so as to be of regular octagonal shape in any such cross-section.

The or each container may be frusto-conical.

The generally helical feed means may comprise a plurality of strips secured rigidly to the wall panels of the container. Said openings may be provided between the ends of adjacent strips.

The apparatus may comprise, as a final stage, a container having a plurality of elongate generally longitudinally extending slots of a size less than that of the smallest workpiece to permit separation of swarf and the like from the workpieces by passage through the slots.

BRIEF DESCRIPTION OF THE DRAWINGS

The invention will now be described in more detail by way of example only with reference to the accompanying drawings in which.

DESCRIPTION OF THE PREFERRED EMBODIMENTS

Figure 1:
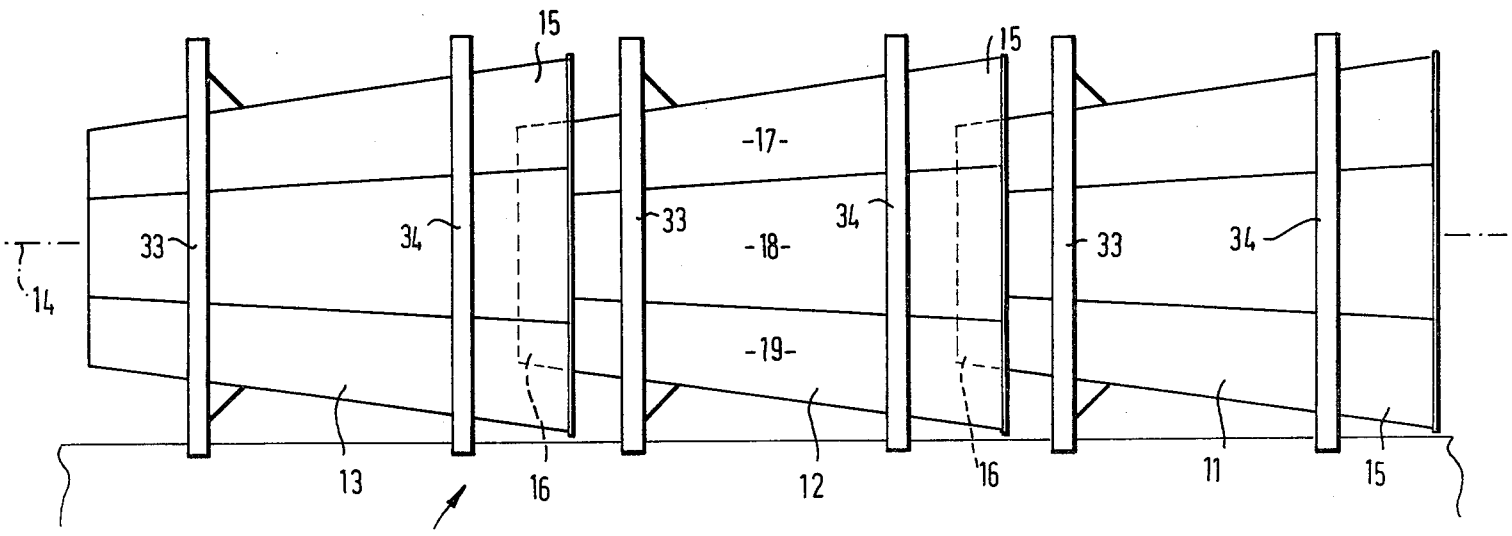
FIG. 1 is a side elevational view of a three stage spray washing apparatus embodying the invention.
Figure 2:
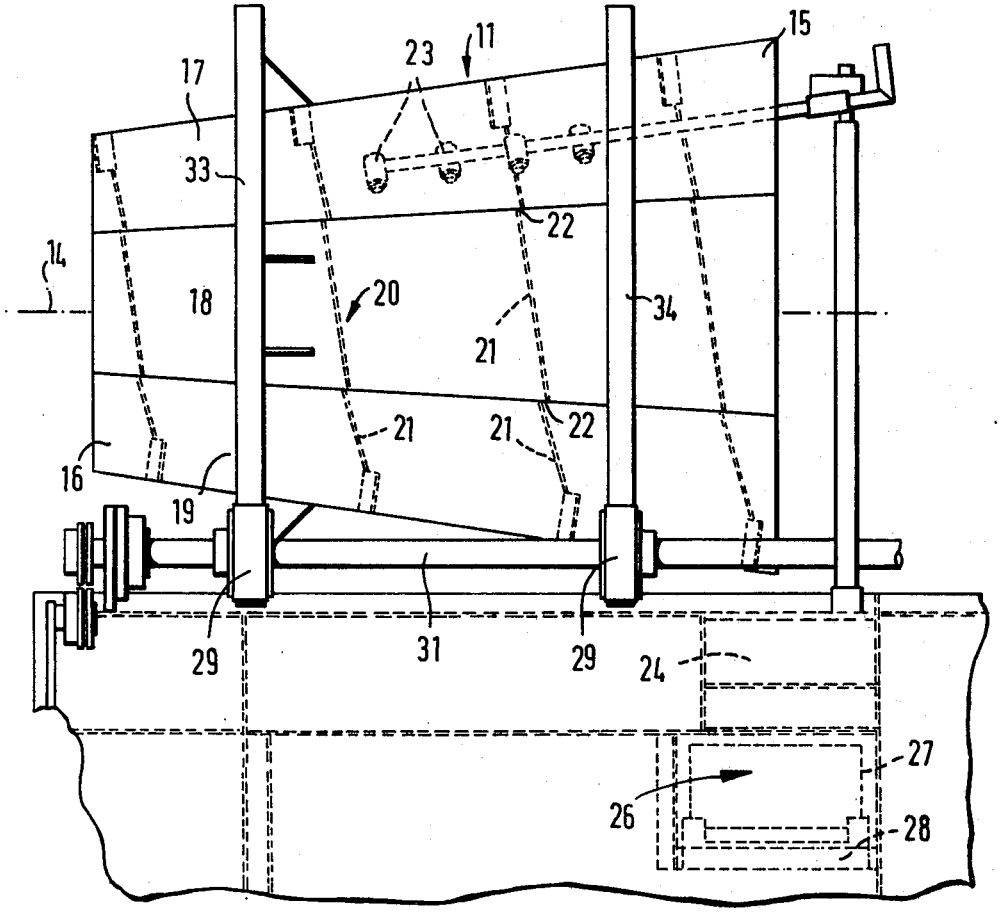
FIG. 2 is a side elevation of a container forming part of the apparatus.
Figure 3:
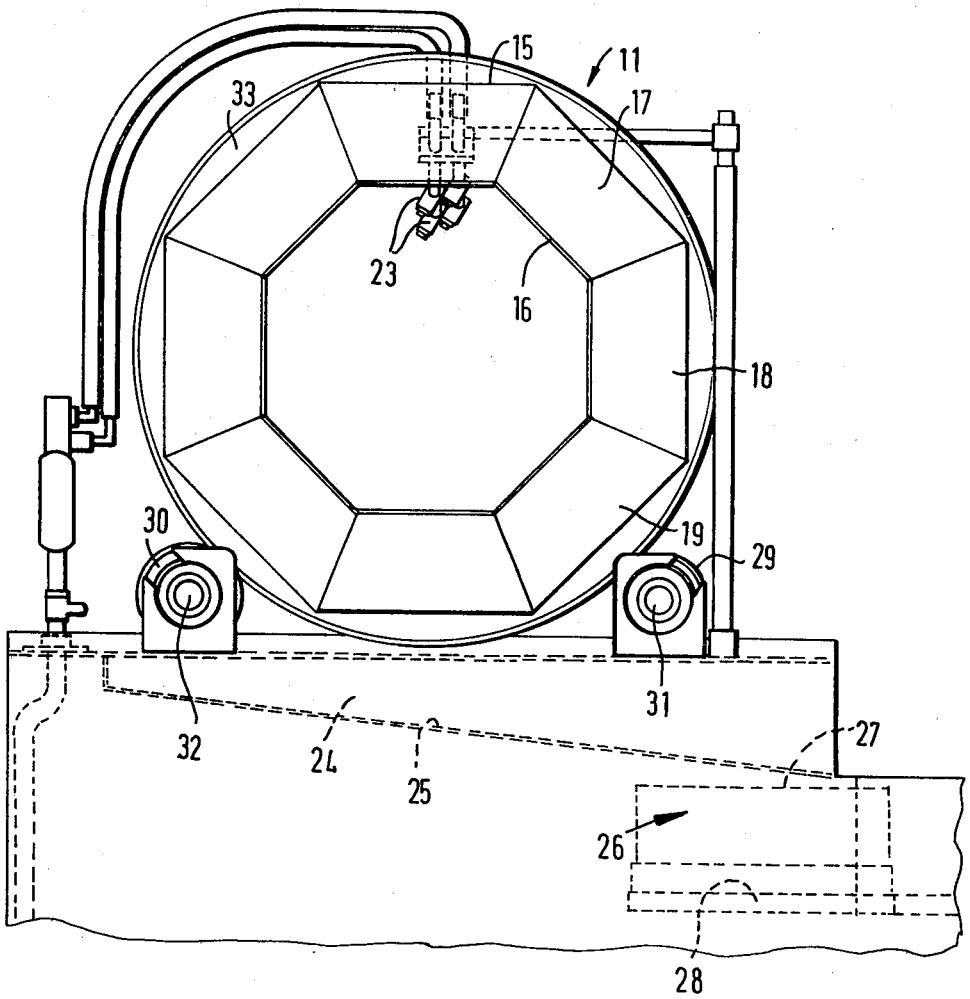
FIG. 3 is an end elevation of the container forming part of the apparatus.

Referring to FIG. 1 of the drawings, a spray washing apparatus for small workpieces is generally indicated at 10 and comprises three containers 11, 12, 13 which respectively provide a hot washing stage, a cold rinsing stage and a hot rinsing stage for workpieces to be treated. Each of the containers 11, 12, 13 is substantially identical and FIGS. 2 and 3 show a typical container in more detail. However, in general, it is to be noted that the machine has a frame including roller tracks to be described, on which the containers are mounted coaxially about a common generally horizontal rotational axis 14. Each container 11, 12, 13 tapers from a large intake end 15 to a small outlet end 16, which is received within the large intake end 15 of the next adjacent container. As will subsequently be described, feed means are provided inside each of the containers to feed workpieces along from the intake end to the outlet end, from which they subsequently fall into the intake end of the next adjacent container. It will be seen that the length and the taper of the containers is such that they can be interfitted in the manner described.

Turning to FIGS. 2 and 3 of the drawings, a typical container which will be given reference numeral 11, is shown. The container is of a tapering shape and is made up of a plurality of wall panels 17, 18, 19 for example, which are of truncated triangular shape. In the example shown, eight such wall panels are provided and together form a container of regular octagonal cross-section taken in any plane perpendicular to the axis of the container. Alternatively the container could be truly frusto-conical.

Each container is supported by two pairs of rotating rollers 29, 30, rotated by shafts 31, 32 respectively. Each container has a pair of external parallel, axially spaced-apart, coaxial annular tracks 33, 34, which run on the rollers 31, 32 to provide the rotary movement of the containers.

A generally spiral or helical feed means of the type known as an Archimedes scroll is provided inside each of the containers. This feed means causes workpieces within the container to move along from the intake end 15 to the outlet end 16 as the container rotates about its axis 14.

Although it would be possible to provide a continuous scroll which is welded to the interior of the container throughout its length, it has been found that the scroll 20 can be provided in the form of generally rectangular metal strips 21 each strip spanning one of the wall panels 17, 18, 19 and the strips being closely overlapped in generally parallel relationship at their ends. In this way, small openings 22 are provided between the strips 21, to enable treatment liquid to flow back down the container under gravity, in a direction opposed to the direction of travel of the workpieces under the feeding action of the scroll 20.

Drainage of treatment liquid may be improved, for example where heavy spraying is to take place, either by using perforated metal for the strips 21 or by providing the strips 21 with slots.

The use of separate individual strips 21 to form the scroll also simplifies greatly its design, construction and securing in position.

Towards the intake end 15 of the container, the strips are abutted so that the openings 22 are not provided. In this way, the end portion of the scroll 20 at the lowermost part of the container is less capable of allowing the treatment liquid to drain away throughout most of its rotational cycle. The liquid can of course drain to some extent either over the scroll or through perforations or slots in the scroll, where these are provided. When the end of the scroll coincides with the lower part of the container during its rotation, there is free outflow for the treatment liquid.

Thus, the intake end 15 of the container affords a reservoir for the treatment liquid, into which the workpieces are initially deposited either from a feeder or from the outlet end of the preceding container. The workpieces therefore tend to fall into a reservoir of treatment liquid and are then transported by the scroll along the container, through a countercurrent of treatment liquid, to the spray zone.

A plurality of spray heads 23 are provided within the container at a position spaced from the intake end. It is convenient to mount the spray heads on spray pipes which are introduced through the intake end of the container between that intake end and the outlet end of the preceding container.

The spray heads may of course by connected to a supply of any type of treatment liquid, for example detergent solution, rinsing water, acid, or solvent, depending on what process is to be carried out. In the spray washer shown, the first container 11 provides a washing stage and the spray heads 23 thereof are supplied with preheated detergent solution. The second container 12 forms a rinsing station and the spray heads 23 are provided with clean rinsing water. In the third container, the spray heads are provided with hot rinsing water.

At the intake end 15 of each container which is supplied with a liquid treatment medium, there is a drainage trough 24 disposed so as to catch the liquid outflow, which falls from the intake end intermittently, when the end of the scroll coincides with the lowermost part of the container during rotation. The trough has an inclined undersurface 25 so as to feed the liquid transversely of the axis 14 to a filter box 26. The filter box is fitted with a fine wire mesh or similar screen 27 which catches fairly large particles of swarf or other material which may be caught up in the liquid stream. A settlement tank 28 is disposed below the screen 27 in the filter box and relatively finer particles settle out at the bottom of the tank 28. The treatment medium can be discarded or, more usually, will be recycled to the spray heads 23, either by direct pumping from the settlement tank or by initially being fed into a holding tank (not shown), from which it is pumped to the spray heads 23.

It will be seen that, because each treatment stage is carried out in a separate container, there is little or no contamination of the treatment liquids with liquid from the preceding stage. To reduce the possibility of contamination, the workpieces are fed for some distance beyond the spray heads 23 so as to permit the treatment liquid to drain off them, before reaching the outlet end 16 of the container and being fed into the next adjacent container. Additionally, a flexible baffle plate (not shown) may be mounted behind the spray heads to screen the outlet end of the container.

The treatment apparatus described has various advantages, stemming largely from the tapering shape of the containers used for the treatment stages. These containers could be fabricated as frusto-conical sheet metal structures but the octagonal cross-section described above is preferred because the workpieces are then subjected to a more vigorous tumbling action because of the sudden changes in inclination of the surfaces on which they are resting as the container rotates. The tumbling action is more vigorous than would be the case with a smooth frusto-conical wall.

By the use of a container which tapers along its length, a continuous drainage of the treatment liquid from the spray jets can be permitted without the need for the container to be mounted on an inclined axis. Furthermore, the shape of the container enables the containers to be interfitted one into another as shown in FIG. 1 so that each container can feed workpieces directly from its own outlet end 16 into the intake end 15 of the next adjacent container without the need for successive containers to increase in overall size. The use of separate containers for the stages, in addition to reducing the risk of contamination of treatment liquid, enables the apparatus to be very versatile because each container can be arranged to rotate independently of the others.

For example, in phosphating and pickling processes, it may be advantageous for articles to remain longer or shorter periods in successive stages of the treatment. Pickling is preferably carried out a relatively rapid speed with strong agitation and this could be achieved for example by doubling the speed of rotation of the container in which the pickling treatment is carried out and reducing the pitch of the Archimedes screw feed inside, to one half the pitch of the preceding stage. The transit time through the container would then be exactly the same as through the preceding container but the treatment conditions would be improved by the agitation of the articles to be treated during the relatively rapid tumbling movement they would undergo. In contrast, phosphating might with advantage be carried out more slowly, and in this case one could double the pitch of the helix and halve the speed.

It is unnecessary for all the transit times through the containers to be equal in any continuous process. The apparatus is so constructed that the process will be carried out continuously so that it is merely necessary to adjust the number of workpieces fed per unit time to the first stage container to a value which is consistent with satisfactory treatment through the line.

It is intended that, where articles to be treated include quantities of long swarf or other relatively large pieces of extraneous material, this would pass through the process line without removal. Only very small particles would be carried back by the treatment liquids in the various stages and filtered out in the filter boxes 26. At the end of the process line, there is provided a swarf breaker (not shown) which is in the form of a container of either tapering or cylindrical form which is constructed by means of for example channel or angle section elements bolted together with elongate slots between them. The panels of the final container are arranged in a many sided polygonal form and the rapid rotation of this container tends to break up and force the swarf through the slots, while feeding the workpieces through in the previously described manner. A swarf removing conveyor or collector can be provided below the container to receive material passing through the slots.

The swarf breaker also serves to remove excess liquid trapped within cup-shaped workpieces by causing them to tumble vigorously. In certain cases, the elongate slots might be unnecessary and the container would be made of perforated material.

An optional additional stage (not shown) comprises a drying unit made of perforated sheet material and preferably polygonal in cross-section to promote tumbling of the workpieces. A feed scroll conveys the workpieces through the drying unit which is parallel-sided and enclosed in an insulated housing through which heated air is blown to dry the workpieces.

I claim:

1. A spray treatment apparatus for small workpieces, the apparatus comprising a frame, at least two containers rotatably mounted on the frame about a generally horizontal rotational axis, each container having an intake end and an output end and a generally helical feed means extending along the interior of the container from the intake to the output end so as to feed workpieces along the container on rotation thereof about its axis, the output end of one container being disposed within the intake end of the next adjacent container so that the workpieces are fed from said one to said next adjacent container on rotation of said one container, and each container tapering inwardly towards its axis in a direction from the intake to the output end thereof, and spray means spaced inwardly from the intake end of each container to spray treatment liquid on workpieces therein.

2. Apparatus according to claim 1 wherein each container is separately mounted for rotation and separately driven, whereby the containers may be arranged to rotate at different speeds and/or in opposed rotational directions.

3. Apparatus according to claim 2 wherein a pair of external, parallel, axially spaced apart, coaxial annular tracks are provided on the or each container, each track being co-operable with a pair of support rollers so as to provide rotational mounting means for the container.

4. Apparatus according to claim 1 wherein each container has a plurality of wall panels so as to be polygonal in any cross-section taken perpendicular to the axis.

5. Apparatus according to claim 4 wherein the generally helical feed means comprise a plurality of strips secured rigidly to the wall panels of the container.

6. Apparatus according to claim 5 wherein openings are provided between the ends of adjacent strips, each of a size less than the size of the smallest workpieces to be treated, for drainage of treatment liquid towards the intake end of the container.

7. A spray treatment apparatus for small workpieces, the apparatus comprising a frame, at least two containers rotatably mounted on the frame about a generally horizontal rotational axis, each container having an intake end and a an output end and a generally helical feed means extending along the interior of the container from the intake to the output end so as to feed workpieces along the container on rotation thereof about its axis, the output end of one container being disposed within the intake end of the next adjacent container so that the workpieces are fed from said one to said next adjacent container on rotation of said one container, and each container tapering inwardly towards its axis in a direction from the intake to the output end thereof, and spray means spaced inwardly from the intake end of each container to spray treatment liquid on workpieces therein, and each container being separately mounted for rotation and separate drive means being provided for each container, whereby the containers may be independently rotated at different speeds and/or in opposed rotational directions.

8. Spray treatment apparatus for small workpieces the apparatus comprising a frame, at least one container rotatably mounted on the frame about a generally horizontal rotational axis, the container having an intake end and an output end and a generally helical feed means extending along the interior of the container from the intake end to the output end so as to feed workpieces along the container on rotation thereof about its axis, the container tapering inwardly towards the axis in a direction from the intake to the output end of the container, the container comprising a plurality of substantially flat wall panels and being of polygonal cross-section in planes perpendicular to its axis, and the helical feed means comprising a plurality of generally flat strips secured rigidly to the respective wall panels of the container.

* * * * *